US005119142A

United States Patent [19]

Swapceinski et al.

[11] Patent Number: 5,119,142

[45] Date of Patent: Jun. 2, 1992

[54] IMAGE FIXING DEVICE HAVING HEAT RECYCLING MEANS

[75] Inventors: John P. Swapceinski, Bergen; Timothy H. Kelley, Rochester, both of N.Y.

[73] Assignee: Eastman Kodak Company, Rochester, N.Y.

[21] Appl. No.: 754,489

[22] Filed: Sep. 3, 1991

[51] Int. Cl.[5] ..... G03G 15/20

[52] U.S. Cl. ..... 355/285; 165/86; 165/185

[58] Field of Search ..... 118/60, 101; 165/86, 165/185; 219/216, 469, 470, 471; 355/282, 285, 289, 290; 432/59, 60

[56] References Cited

U.S. PATENT DOCUMENTS 3,356,831 12/1967 Andrus et al. ..... 355/282 X 3,810,735 5/1974 Moser ..... 432/59

*Primary Examiner*—A. T. Grimley
*Assistant Examiner*—P. Stanzione
*Attorney, Agent, or Firm*—Leonard W. Treash, Jr.

[57] ABSTRACT

A fixing device fixes a toner image to a receiving sheet, especially to a receiving sheet having a heat softenable thermoplastic layer. The device has an endless belt which moves from a pressure nip through a cooling path away from the nip and then returns to the pressure nip. A heat exchanging roller is positioned between the portions of the path of the belt to subtract heat from the belt as it moves away from the nip and return that heat to the belt as it again approaches the nip. The heat exchanging roller has a thin conductive layer on an insulating core which thermally matches with the belt to increase the thermal efficiency of the fixing device.

8 Claims, 3 Drawing Sheets

IMAGE FIXING DEVICE HAVING HEAT RECYCLING MEANS

RELATED APPLICATION

This application is related to co-assigned U.S. patent application Ser. No. 07/754490, filed Sep. 3, 1991, METHOD AND APPARATUS FOR PREHEATING AND PRESSURE-FIXING A TONER IMAGE, T. J. Farnand et al.

TECHNICAL FIELD

This invention relates to the fixing of toner images, for example, toner images created electrophotographically. Although not limited thereto, it is particularly useful in fixing color toner images carried on a receiving sheet having a heat softenable outside layer.

BACKGROUND ART

U.S. patent application Ser. No. 405,258, filed Sep. 11, 1989 in the name of Rimai et al, and U.S. Pat. No. 5,023,038, issued Jun. 11, 1991 in the name of Aslam et al disclose a method and apparatus for fixing a multicolor toner image carried on a heat softenable outside layer of a receiving sheet. The receiving sheet is passed across a preheating plate to raise the temperature of the thermoplastic layer to or above its softening point. It is fed into a pressure nip created by a pressure roller and a belt or web backed by a heated roller. The belt or web is of a hard ferrotyping material such as stainless steel, nickel or the like. Relatively high pressure is applied between the belt and pressure roller to embed much or all of the toner image in the thermoplastic layer fixing the image. Some of the toner may be not entirely embedded but may be fused on the top of the layer, but with much of it embedded, the hard ferrotyping belt provides a photographic quality with an absence of relief and a high gloss. The image and heat softenable layer are retained in contact with the belt as it moves away from the pressure nip. The belt and receiving sheet are allowed to cool until the heat softenable layer is below its glass transition temperature. At this point it can be separated without offset. All this is accomplished without the use of offset-preventing substances like powders or liquids which would reduce the photographic quality of the image.

Other belt fixing devices are generally known for fixing toner images to plain paper. See, for example, European Patent Application 0301585, published Feb. 1, 1989; European Patent Application 0295901; and U.S. Pat. No. 3,948,215.

In some of the embodiments shown in the Rimai and Aslam applications an endless belt is heated above the glass transition temperature of the heat softenable layer of the receiver and then cooled below that temperature on each revolution. In "Belt Fusing Device", Research Disclosure, July 1990, page 559, it is suggested that a heat pump be used to transfer heat from the portion of the belt being cooled to a portion of the belt approaching the heated roller. Heat pumps are complex and prohibitively expensive for such applications. See also, U.S. Pat. No. 3,356,831 to Andrus et al, issued Dec. 5, 1967, which shows a heat exchange unit between an incoming portion of a web entering an electrophotographic fusing apparatus and the outgoing portion of the same web to reuse some of the fusing energy to preheat the receiver.

DISCLOSURE OF THE INVENTION

It is the object of the invention to provide a fixing device generally of the type described in the Rimai and Aslam applications in which effective heat exchange is accomplished between portions of a ferrotyping belt without utilization of an expensive heat pump.

This and other objects are accomplished by a fixing device which includes an endless belt movable through an endless path, which path includes a cooling portion leading away from a pressure nip and a return portion leading in substantially the opposite direction. A heat exchanging roller is positioned between the cooling and return portions to absorb heat from the belt when it travels through the cooling portion and transfer it to the belt as it travels through the return portion.

According to a preferred embodiment, the heat exchanging roller contacts and is rolled by the inside surfaces of the belt. It contains a thin conductive layer on its outside which is, in fact, insulated from the rest of the roller. The thin layer is thermally matched with the belt to have the greatest effect in transferring heat.

Using this invention, effective heat transfer can be made between the cooling and returning portions of the belt in an extremely simple and reliable structure.

BEST MODES OF CARRYING OUT THE INVENTION

Figure 1:
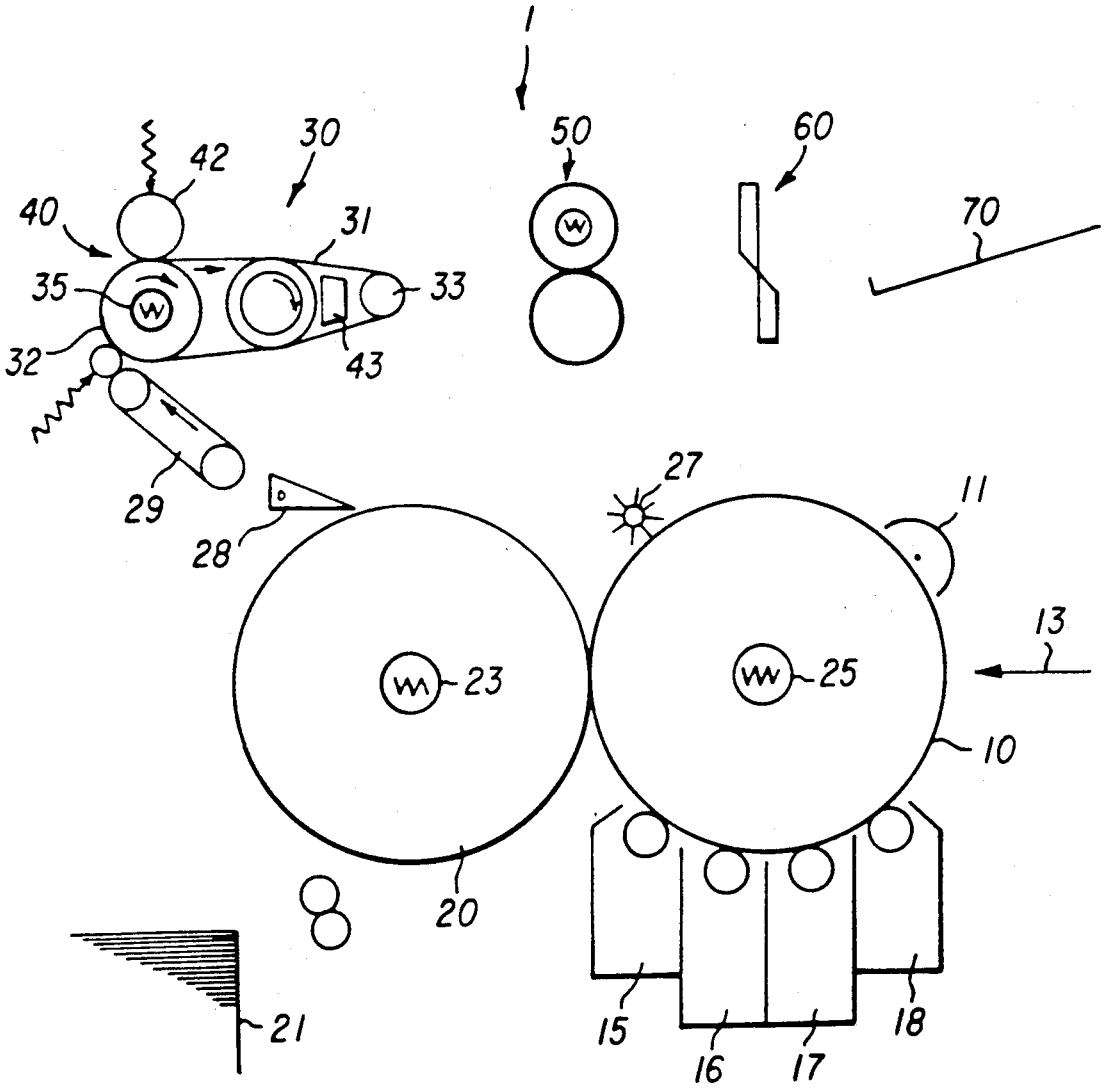
FIG. 1 is a front schematic of a color electrophotographic apparatus in which the invention is particularly usable.

Although not limited thereto, this invention is particularly usable in a color electrophotographic apparatus substantially as shown in FIG. 1. According to FIG. 1, color electrophotographic apparatus 1 includes an image member 10 having an outside or peripheral image surface upon which a series of different color toner images are formed. The image surface can include various photoconductive and other layers making it electrophotosensitive and usable in electrophotography. It is uniformly charged at a charging station 11. The charged surface is imagewise exposed at an exposure station, for example, laser 13 to create a series of electrostatic images. The electrostatic images are each toned by a different one of toning stations 15, 16, 17 and 18 which contain different color toners to create a series of different color toner images. The different color toner images are transferred in registration to a receiving sheet 5 (FIG. 2) to form a multicolor image. The receiving sheet is fed from a receiving sheet supply 21 and secured to the outside surface of a transfer drum 20.

For highest quality work, the receiving sheet has a heat softenable outside layer to which the images are transferred. Such transfer is effected by heating the heat softenable layer, for example, by use of a lamp 23 located inside transfer drum 20. Image member 10 may also be heated to assist in the process by a lamp 25, but should not be heated to a temperature that would cause the toner to stick to the surface of image member 10 or affect the light sensitive properties of its photoconductive layers. Transfer drum 20 is rotated once for each color image to be transferred to cause the receiving sheet to receive the color images in registration, creating a multicolor image partially embedded in the heat softened outside layer. Image member 10 is cleaned by cleaning device 27 for reuse.

When all images have been transferred to the receiving sheet, it is stripped from transfer drum 10 by an articulatable skive 28 and transported by a suitable transport 29 to a fixing device 30. The multicolor toner image is fixed by fixing device 30 utilizing a combination of pressure and heat as will be more fully described. The toner image can be further treated by a texturizing or glossing device 50. It may also be cut into smaller images by a slitting, chopping or other cutting device 60 and ultimately deposited in output tray 70.

Transport device 29 is shown in FIG. 1 as a relatively short transport belt. If fuser 30 is to operate at a slower speed than transfer drum 20, the distance between transport drum 20 and fuser 30 needs to be longer than the longest sheet or a loop or other provision for taking up slack in the sheet must be provided.

Figure 2:
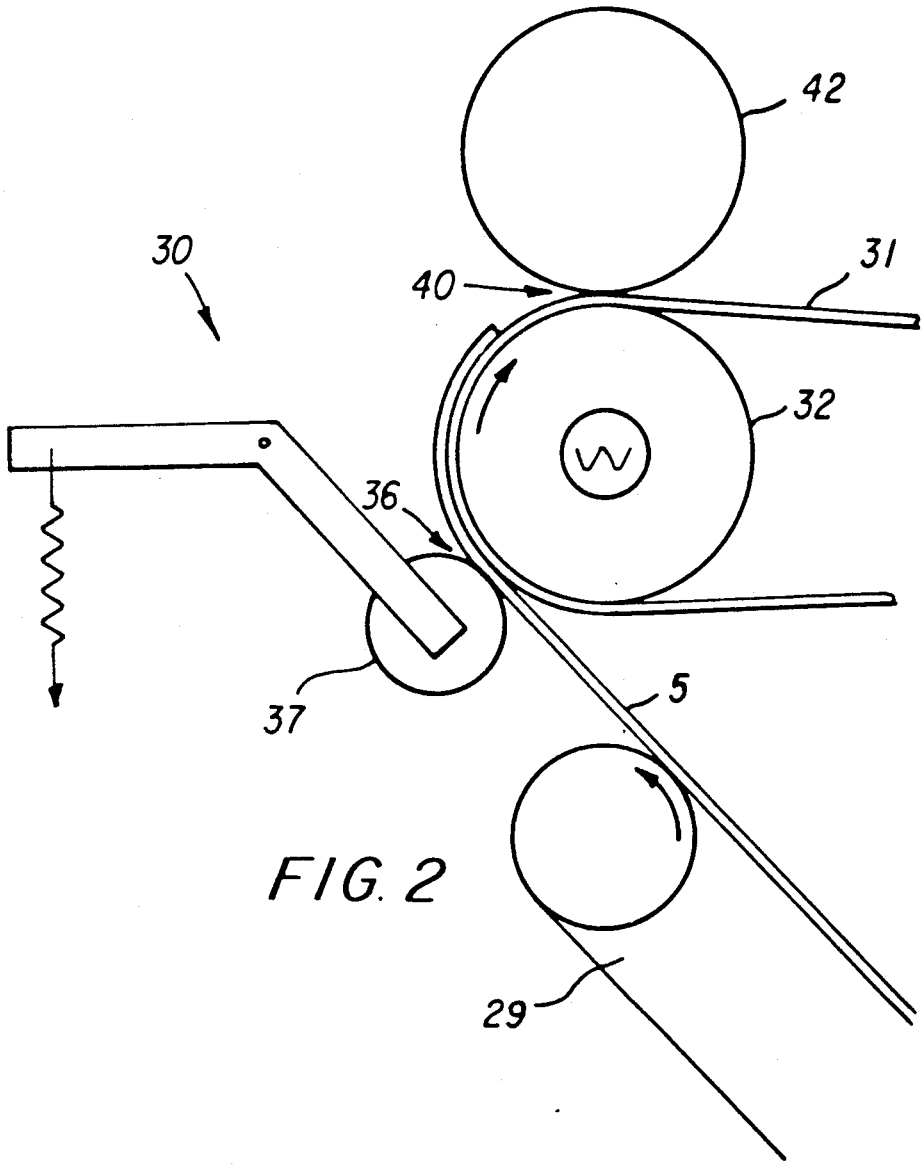
FIG. 2 is a front schematic of a portion of the fixing device forming a component of the apparatus shown in FIG. 1.
Figure 3:
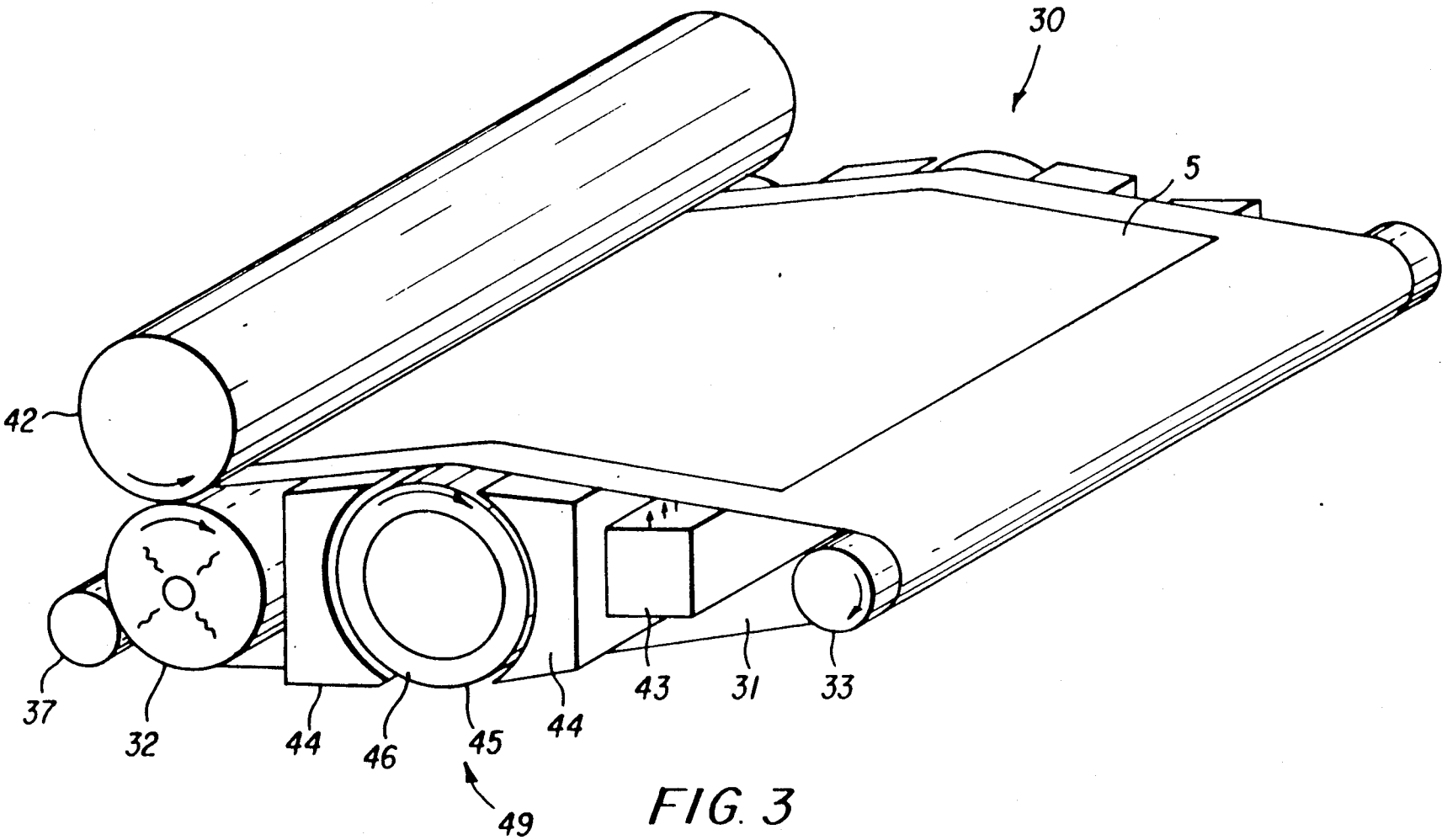
FIG. 3 is a perspective view of the fixing device shown in FIG. 2.

Referring to FIGS. 1-3, fixing device 30 includes a ferrotyping belt 31 which is trained primarily around a pair of rollers, relatively large heated roller 32 and a small separation roller 33. Belt 31 can be any of a number of hard materials, including nickel, stainless steel and other metals, polyethylene, polypropylene and other high melting point plastics. It may be covered by a release material such as certain silicons, polyamides or polytetrafluoroethylenes. For highest quality work, no release liquid is used. Heated roller 32 is heated by an internal lamp 35. Roller 42 may also be heated, but preferably is not.

As best shown in FIG. 2, release sheet 5 is conveyed by transport device 29 into contact with belt 31 at a contact point 36 partially defined by a pressure or scuff roller 37. Scuff roller 37 is spring urged against belt 31 at contact position 36 where belt 31 is backed by heated roller 32.

Belt 31 is driven through an endless path by rotation of heated roller 32. As belt 31 moves in a generally clockwise direction, receiving sheet 5 follows belt 31 into a pressure nip 40 formed between belt 31 and a pressure roller 42. During the transport of the receiving sheet 5 from contact point 36 to nip 40 it is preheated by heated roller 32 through belt 31 to raise the temperature of the heat softenable layer to a temperature above its glass transition temperature.

Other rollers can be provided to maintain receiving sheet 5 against belt 31 between contact point 36 and nip 40. However, using a heat softenable layer of a polyester having a melting point of about 60° C. with a belt 31 maintained at about 100° C., the heat softenable layer becomes sufficiently tacky that it adheres to belt 31. It thus passes into nip 40 without the need of additional rollers to guide it. This aspect is effective even though receiving sheet 5 is of relatively stiff stock to give the final print a photographic quality.

The preheating step has several advantages. It continues to drive moisture out of receiving sheet 5, commonly a process begun in the transfer step. This is best accomplished when the receiving sheet is not in nip 40, since there is a tendency for the receiving sheet to blister if it still contains moisture as it comes out of nip 40. Further, preheating receiving sheet 5 allows the nip 40 to be relatively short in the intrack direction, which further permits both rollers 32 and 42 to be relatively hard, providing the pressure necessary for embedding the toner in the heat softenable layer and obtaining a high gloss.

Note that by contacting the heat softenable layer and belt 31 at the position of contact 36, the heat softenable layer is heated directly for preheating rather than being heated through the other side of the receiving sheet as in the prior art. This has the substantial advantage of assuring that the heat softenable layer is raised in temperature to the appropriate level for fixing without necessarily utilizing energy necessary to heat the rest of the sheet. It also eliminates a costly preheating device that, by necessity, had to be positioned almost into the nip 40 for greatest effectiveness.

Thus, both rollers 32 and 42 are hard rollers. For example, they may both have an aluminum or other metallic surface. Alternatively, pressure roller 42 can have a very thin elastomeric outer layer, for example, from 4 to 40 mils thick. Such a construction still permits pressures in excess of 100 pounds per square inch but with a small amount of compliance, which compliance helps equalize fixing between the image and non-image areas.

After receiving sheet 5 passes through nip 40, it continues on belt 31 for a sufficient distance to allow it to cool until the heat softenable layer of receiving sheet 5 is below its glass transition temperature. At this point the belt 31 passes around small separation roller 33 and the receiving sheet, because of its stiffness, separates from belt 31 and passes on to be further processed.

The cooling process can be assisted by removing heat from belt 31 as it moves from nip 40 to separation roller 33. For example, as seen in FIG. 3, a cooling air manifold 43 can force cooling air against the back of web 31 to reduce its temperature. To increase the efficiency of the fixing device 30, heat may be removed from the cooling portion of the path of web 31, i.e., that portion of the path extending away from nip 40, by a roller heat exchanging device 49 and returned to web 31 at its lower portion which returns to heated roller 32. More specifically, a roller 46 having a heat insulating core, such as a thermoset plastic or glass, is coated with a thin layer of heat conductive material, for example, a 5 mil thick layer 45 of copper. Roller 46 is journaled for rotation by frictional engagement with belt 31 and is insulated on both sides by appropriate insulation material 44, which may also be a thermostat plastic.

Copper layer 45 contacts the lower surface of belt 31 in the portion of its path leading away from heated roller 32 and nip 40 and absorbs heat from it, lowering the temperature of the belt and raising the temperature of the copper layer 45. Belt 31 goes on to be air cooled by manifold 43 and returns toward roller 32 on the lower portion of its path at a somewhat cooler temperature. The heat absorbed from the upper portion of belt 31 in copper layer 45 is passed on to the lower portion of belt 31 thereby cooling the copper layer of roller 46 and warming belt 31 as it again approaches heated roller 32.

Copper layer 45 is thermally matched with belt 31. Its thinness allows its temperature to be substantially reduced by belt 31 as the belt returns to heated roller 32 so that it can then absorb substantial heat from the upper portion of the belt.

The following example is illustrative only; the temperature can be varied substantially while retaining the advantages of the devices, especially if different materials are used. A receiving sheet having a toner image on a heat softenable polyester layer having a glass transition temperature of about 60° C. and a toner image also having a glass transition temperature of about 60° C. is fixed with a device constructed according to the FIGS. and including a heated roller 32 that heats belt 31 to a temperature in excess of 100° C., for example, 130° C. Heated roller 32 and pressure roller 42 are urged together with sufficient force to create a pressure between belt 31 and pressure roller 42 in excess of 100 pounds per square inch, preferably in excess of 300 pounds per square inch. This pressure, of course, is partially a function of the hardness of the pressure roller 42, belt 31 being a hard ferrotyping belt. As belt 31 moves away from nip 40 and contacts heat exchanging roller 46, it has a temperature of between 110° and 130° C. That temperature is substantially reduced by heat exchanging roller 46 and cooling air manifold 43 until its temperature is as low as 35° C. as belt 31 passes around separation roller 33. At this temperature, the heat softenable layer on the receiving sheet separates readily from belt 31 without offset of toner or portions of the heat softenable layer onto the belt. This substantially cooled belt then is heated by as much as 30° C. when it contacts heat exchanging roller 46 again. At this point the layer 45 and the belt 31 reach a temperature equilibrium at approximately 60° C., which both warms belt 31 as it approaches heated roller 32 and cools conductive layer 45 for its return to contact of the upper portion of belt 31. This structure adds substantial thermal efficiency to the fixing device without the use of expensive exchange apparatus such as a heat pump or the like.

The invention has been described in detail with particular reference to a preferred embodiment thereof, but it will be understood that variations and modifications can be effected within the spirit and scope of the invention as described hereinabove and as defined in the appended claims.

We claim:

1. A fixing device for fixing a toner image to a receiving sheet, said device comprising:

a source of heat, an endless belt moving through an endless path and positioned to receive a receiving sheet with said toner image in contact with said belt, said endless path having a first portion in thermal association with said heat source for heating said belt and said toner image, a second portion extending away from said heat source during which said belt and the image cool and a third portion leading back to said source in which said receiving sheet is no longer in contact with said belt, said belt moving substantially in opposite directions in said second and third portions, and a heat exchanging roller positioned between and thermally associated with said second and third portions and rotatable to receive heat from said second portion and transfer such heat to said third portion.

2. A fixing device for fixing a toner image to a receiving sheet, said device comprising:

an endless belt trained about at least a first heated roller and a second roller, and movable through an endless path, which path includes a cooling portion leading away from said heated roller and a return portion leading back to said heated roller, said portions moving in opposite directions during operation, and a heat exchanging roller positioned between and thermally associated with said cooling and return portions to receive heat from said belt in said cooling portion and transfer it to said belt in said return portion.

3. A fixing device according to claim 2 wherein said heat exchanging roller contacts said belt and is rolled by it.

4. A fixing device according to claim 2 wherein said heat exchanging roller has an insulating core and a thin thermally conductive layer on said core, which thin conductive layer contacts said endless belt as it moves through the cooling portion of its path and as it moves through the return portion of its path.

5. A fixing device according to claim 2 further including air cooling means located between said heat exchanging roller and said second roller for applying cooling air to said belt as it passes from said heat exchanging roller to said second roller.

6. A method of fixing a toner image partly embedded in a heat softenable layer carried on a receiving sheet, said method comprising passing said receiving sheet through a pressure nip between a pressure roller and a hard ferrotyping belt backed by a heated roller with the heat softenable image-carrying layer in contact with said belt, applying sufficient pressure between said pressure roller and said belt to fix said toner image in said heat softenable layer, moving said belt from said nip through a path leading away from said nip to a separation roller and then back to said heated roller and said nip, cooling said belt as it moves away from said nip to cool said heat softenable layer to a temperature below its glass transition temperature, separating said receiving sheet from said belt at said separation roller, and contacting said belt both as it moves away from said nip and as it returns to said heated roller by a heat exchanging roller which removes heat from said belt as it moves away from said nip and adds heat back to said belt as it returns to said heated roller.

7. The method according to claim 6 wherein said heat exchanging roller has a heat insulating core and a thin heat conductive layer on said core which contacts a belt.

8. The method according to claim 7 wherein said heat conductive layer is a layer of copper approximately 5 mils thick.

* * * * *